US012180857B2

(12) United States Patent
Place et al.

(10) Patent No.: US 12,180,857 B2
(45) Date of Patent: Dec. 31, 2024

(54) TURBINE AIRFOIL ATTACHMENT WITH SERRATION PROFILE

(71) Applicant: Raytheon Technologies Corporation, Farmington, CT (US)

(72) Inventors: Emma J. Place, New Hartford, CT (US); Bryan P. Dube, Chepachet, RI (US); Pedro D. Laureano, Jacksonville, FL (US); Bernard Joseph Reilly, III, Coventry, CT (US); Mohamed Hassan, Palm City, FL (US); Edwin Otero, Southington, CT (US); Andrew Correia, Manchester, CT (US); William R. Hackbarth, II, Colchester, CT (US); Jeffrey M. Jacques, East Hartford, CT (US)

(73) Assignee: RTX CORPORATION, Farmington, CT (US)

( * ) Notice: Subject to any disclaimer, the term of this patent is extended or adjusted under 35 U.S.C. 154(b) by 81 days.

(21) Appl. No.: 18/304,922

(22) Filed: Apr. 21, 2023

(65) Prior Publication Data

US 2024/0352861 A1 Oct. 24, 2024

(51) Int. Cl.
*F01D 5/30* (2006.01)
*F01D 5/02* (2006.01)

(52) U.S. Cl.
CPC ..... *F01D 5/3007* (2013.01); *F01D 5/02* (2013.01)

(58) Field of Classification Search
CPC ..... F01D 5/3007
See application file for complete search history.

(56) References Cited

U.S. PATENT DOCUMENTS

| | | | | |
|---|---|---|---|---|
| 4,260,331 | A * | 4/1981 | Goodwin | F01D 5/3007 416/219 R |
| 4,824,328 | A | 4/1989 | Pisz et al. | |
| 8,047,797 | B2 | 11/2011 | Cosi | |
| 9,976,428 | B2 | 5/2018 | Snyder | |
| 10,677,073 | B2 * | 6/2020 | Thistle | F01D 5/26 |
| 2009/0208339 | A1 | 8/2009 | Cherolis et al. | |
| 2014/0083114 | A1 | 3/2014 | Beattie et al. | |
| 2015/0361803 | A1 | 12/2015 | Bluck et al. | |
| 2016/0169011 | A1 | 6/2016 | Lana | |
| 2022/0251959 | A1 | 8/2022 | Pernleitner et al. | |

OTHER PUBLICATIONS

Extended European Search Report for European Patent No. 24170591.2, Dated Jul. 22, 2024, 9 Pages.

* cited by examiner

*Primary Examiner* — Sabbir Hasan
(74) *Attorney, Agent, or Firm* — Kinney & Lange, P.A.

(57) ABSTRACT

An attachment root for a blade includes a symmetric serration profile with multiple lobes. Contact surfaces of each lobe form equal contact angles with a line normal to a symmetry plane of the serration profile. Non-contact surfaces of lobes form angles greater than three degrees relative to the line that increase in a radially inward direction.

17 Claims, 4 Drawing Sheets

TURBINE AIRFOIL ATTACHMENT WITH SERRATION PROFILE

BACKGROUND

Gas turbine engines produce work by introducing fuel into a compressed air flow produced by one or more compressor stages, combusting the air-fuel mixture in a combustor, and expanding the exhaust flow across one or more turbine stages. Rotors of compressor stages and turbine stages include airfoils that rotate to compress the airfoil or extract work from the airfoil during operation of the gas turbine engine. The airfoils can be attached to the rotors by an attachment root. During operation, the attachment root restrains the airfoil against centripetal force, which imposes relatively high stress levels within the attachment root. High stress levels may accelerate wear and tear on the airfoil particularly when combined with high temperatures.

SUMMARY

An attachment root according to an example embodiment of this disclosure includes a serration profile and a first lobe. The serration profile is symmetric about a plane that bisects the serration profile. The first lobe is spaced from the plane and described relative to a line that is normal to the plane. The first contact surface of the first lobe defines a first acute angle between the first contact surface and the line that is equal to forty-five degrees. The first non-contact surface of the first lobe defines a second acute angle between the first non-contact surface and the line that greater than three degrees.

DETAILED DESCRIPTION

Figure 1:
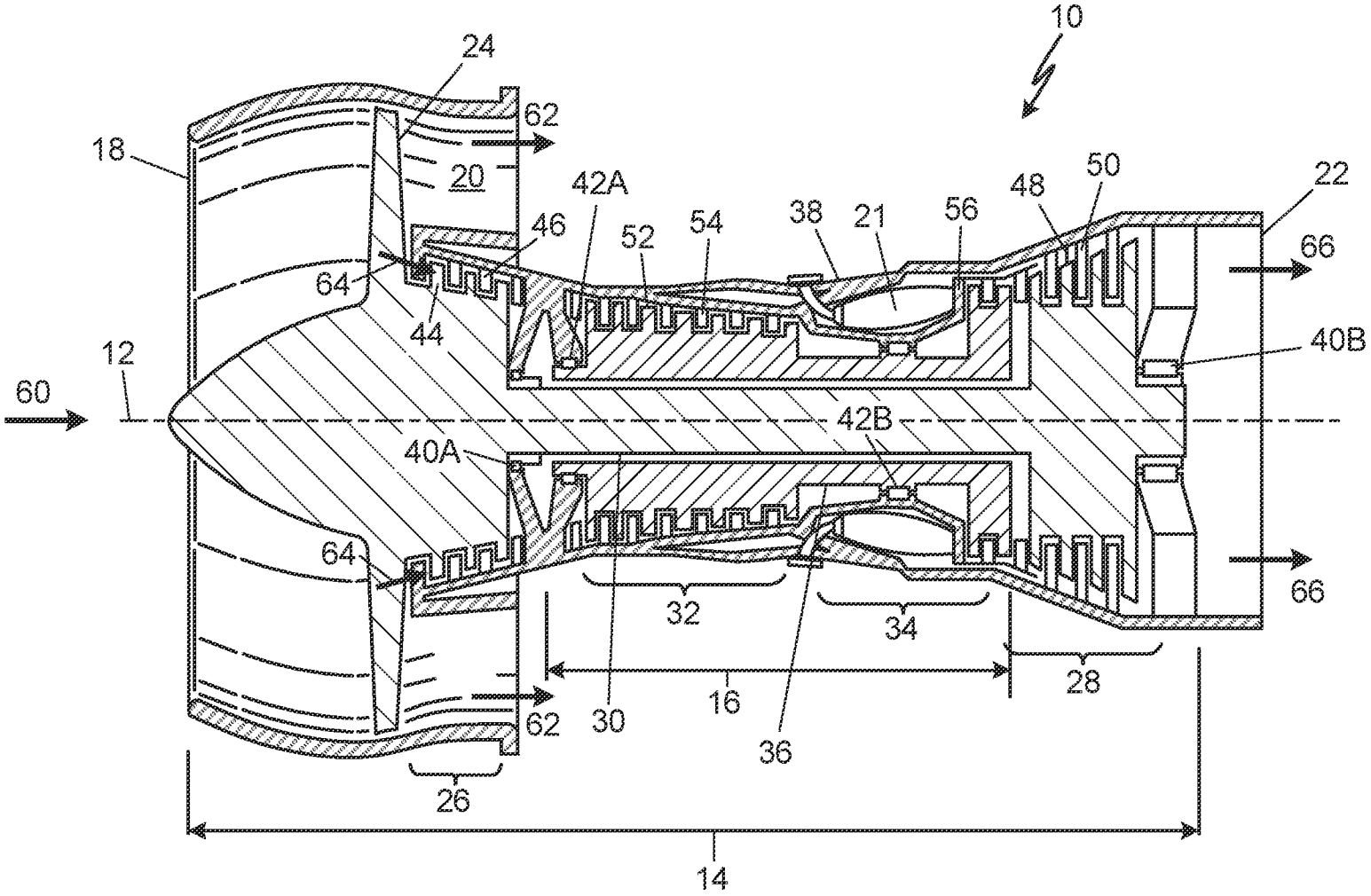
FIG. 1 is a schematic view of a gas turbine engine.

FIG. 1 is a schematic view of gas turbine engine 10 in accordance with an example embodiment of this disclosure. Gas turbine engine 10 extends about centerline axis 12 and includes low-pressure spool 14, high-pressure spool 16, inlet 18, bypass duct 20, and combustor 21, and outlet 22. Low-pressure spool 14 includes fan 24, low-pressure compressor 26, low-pressure turbine 28, and shaft 30. High-pressure spool 16 includes high-pressure compressor 32, high-pressure turbine 34, and shaft 36. Gas turbine engine 10 includes one or more casing sections generally represented at 38. Each of low-pressure spool 14 and high-pressure spool 16 can be supported by casing 38 in a lateral direction with respect to centerline axis 12 via two or more bearings and axially along centerline axis 12 by at least one bearing. For example, forward bearing 40A and aft bearing 40B support low-pressure spool 14 while forward bearing 42A and aft bearing 42B support high-pressure spool 16. Low-pressure spool 14 and high-pressure spool 16 rotate independently from each other about centerline axis 12 and, thus, may rotate at different speeds.

Each of low-pressure compressor 26, low-pressure turbine 28, high-pressure compressor 32, and high-pressure turbine 34 include one or more stages, each stage including one or more rows of blades operatively associated within one or more rows of vanes. As shown, low-pressure compressor 26 includes three stages, each stage formed by rows of low-pressure compressor blades 44 and corresponding rows of low-pressure compressor vanes 46. Low-pressure turbine 28 includes three stages formed by alternating rows of low-pressure turbine blades 48 and low-pressure turbine vanes 50. Similarly, high-pressure compressor 32 includes seven stages formed by rows of high-pressure compressor blades 52 and high-pressure compressor vanes 54. High-pressure turbine 34 includes two stages formed by rows of high-pressure turbine blades 56 and high-pressure turbine vanes 58.

In operation, rotation of fan 24 draws air 60 into gas turbine engine 10 through inlet 18. Fan 24 propels a portion of air 60 into bypass duct 20 to form bypass flow 62 and a remainder portion of air 60 into low-pressure compressor 26 to form core flow 64. Bypass flow 62 is discharged from gas turbine engine 10 via bypass duct 20. Low-pressure compressor 26 imparts work to core flow 64 and thereby compresses core flow 64. High-pressure compressor 32 receives flow from low-pressure compressor 26 where core flow 64 is further compressed by work imparted by high-pressure compressor 32. Fuel injected into combustor 21 mixes with compressed core flow 64 and combusted within combustor 21 to generate exhaust flow 66. High-pressure turbine 32 expands exhaust flow 66, which imparts rotation to high-pressure spool 16. Low-pressure turbine 28 further expands exhaust flow 66, which imparts rotation to low-pressure spool 14. Exhaust flow 66 discharges from gas turbine engine 10 through outlet 22 downstream from low-pressure turbine 28.

Figure 2:
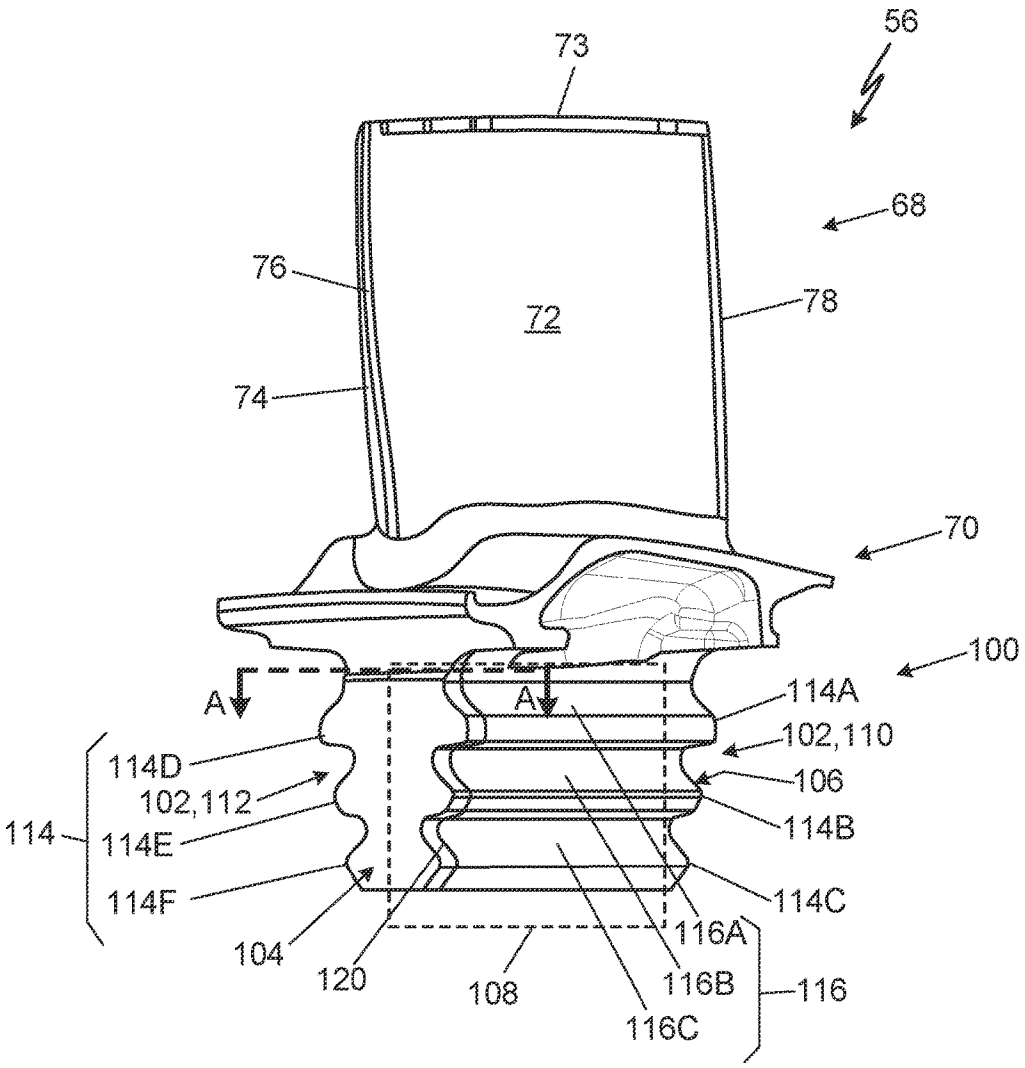
FIG. 2 is an isometric view of an attachment root of an airfoil

FIG. 2 is an isometric view of high-pressure turbine blade 56 that includes airfoil 68, platform 70, and attachment root 100. Airfoil 68 extends outward from platform 70 while attachment root 100 extends inward from an opposite side of platform 70 relative centerline axis 12 when installed within gas turbine engine 10. Airfoil 68 includes pressure side surface 72 and suction side surface 74 extending outward along a spanwise direction from platform 70 to tip 73. Pressure side surface 72 and suction side surface 74 extend from leading edge 76 to trailing edge 78 in a chordwise direction.

Attachment root 100 includes serration profile 102, leading edge end face 104, and trailing edge end face 106. Serration profile 102 extends from leading edge end face 104 to trailing edge end face 106 to form sides of attachment root 100. Serration profile 102 is symmetric about plane 108 to form pressure side profile 110 and suction side profile 112, which is a mirror image of pressure side profile 110. Pressure side profile 110 is associated with pressure side surface 72 of airfoil 68, and suction side surface 112 is associated with suction side surface 74 of airfoil 68. Leading edge end face 104 is associated with leading edge 76 while trailing edge end face 106 is associated with trailing edge 78.

On each side of plane 108, serration profile 102 includes one or more lobes 114. As depicted, attachment root 100 includes lobes 114A, 114B, 114C on pressure side profile 110 and lobes 114D, 114E, and 114F of suction side profile 112. Each lobe 114 includes contact surface 116 and non-contact surface 118. Contact surfaces 116 form a radially outward facing surface of each lobe 114 and are configured to mate with corresponding surfaces of a rotor (i.e., a rotor off high pressure turbine 34). Contact surfaces 116 restrain blade 56 against centrifugal force and acrodynamic loading on airfoil 68 during operation of gas turbine engine 10. Non-contact surfaces 118 form a radially inward facing surface of each lobe 114 and are configured to maintain clearance between attachment root 100 and the rotor (i.e., the rotor of high-pressure turbine 34). Lobes 114A, 114B, and 114C include respective contact surfaces 116A, 116B, 116C and non-contact surfaces 118A, 118B, and 118C. Lobes 114D, 114E, and 114F include respective contact surfaces 116D, 116E, and 116F and respective non-contact surfaces 118D, 118E, and 118F. Contact surfaces 116A-116F and non-contact surfaces 118A-118F are discussed in greater detail below. In some examples, attachment root 100 can include pressure side bevel 120 and suction side bevel 122 (not shown), which are discussed in greater detail below.

Figure 3:
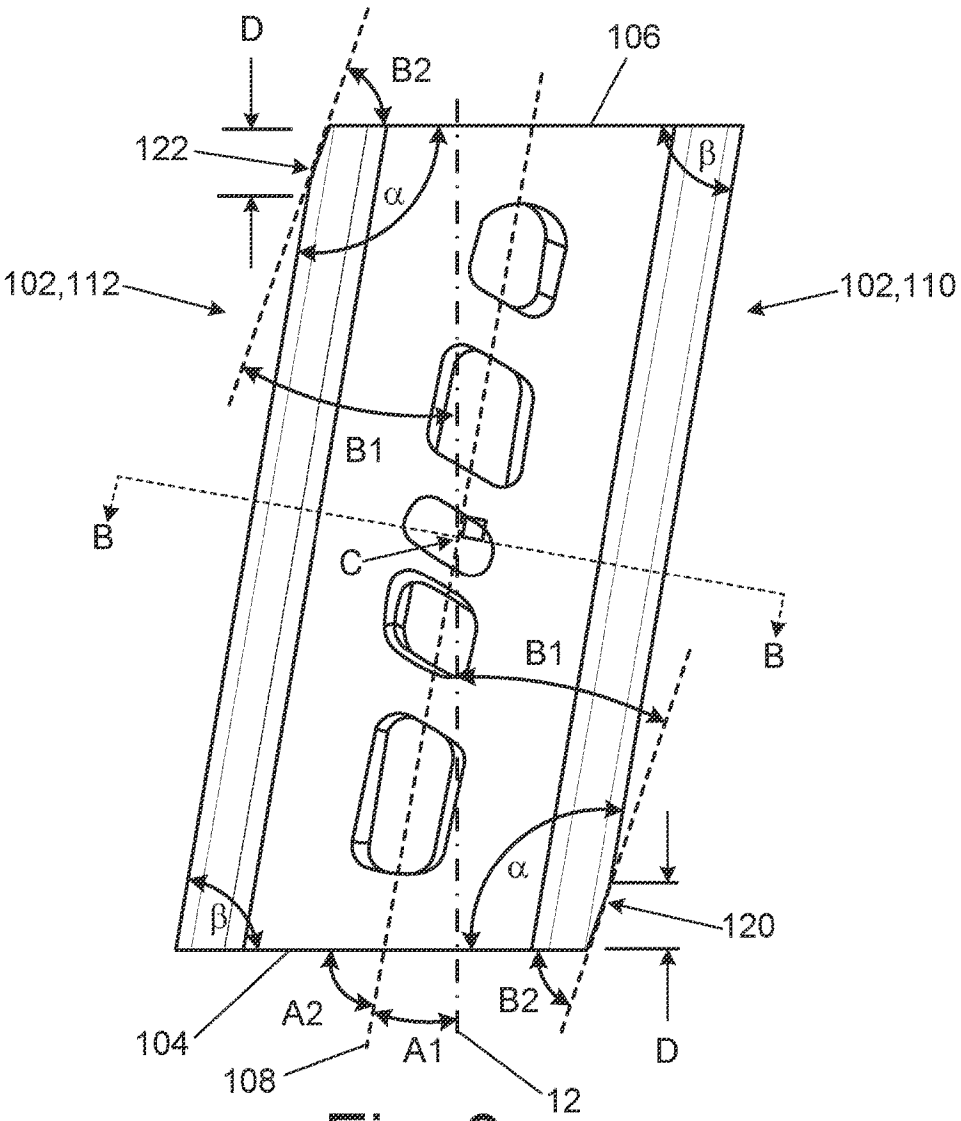
FIG. 3 is a plan view of the attachment root.

FIG. 3 is a plan view of attachment root 100 taken along section A-A in FIG. 2. As shown, serration profile 102 extends between leading edge end face 104 and trailing edge end face 106 along symmetry plane 108. Symmetry plane 108 forms bearing angle A1 relative to centerline axis 12 of gas turbine engine 10. Bearing angle A1 may range from zero degrees (i.e., no bearing angle) to a non-zero, positive angle. In some examples, bearing angle A1 can be greater than zero degrees and less than or equal to ten degrees. For instance, bearing angle A1 equals ten degrees in the depicted example. Leading edge end face 104 and trailing edge end face 106 are parallel while edges of serration profile 102 extend parallel to symmetry plane 108 such that the projected view of attachment root 100 forms a rhombus characterized by obtuse included angles $\alpha$ and acute included angles $\beta$. Pressure side bevel 120, if present, is formed at the intersection of pressure side serration profile 110 and leading edge end face 104 (i.e., adjacent to obtuse included angle $\alpha$). Likewise, suction side bevel 118 is formed at the intersection of suction side serration profile 112 and trailing edge end face 106 when attachment root 100 includes leading edge bevel 118. Pressure side bevel 120 and suction side bevel 122 are parallel and form relief angle B1 with respect to centerline axis 12 of gas turbine engine 10. The profile of pressure side bevel 120 is identical to pressure side profile 110, and the profile of suction side bevel 122 is identical to suction side profile 112. The depth of pressure side bevel 120 and suction side bevel 122 can be defined by perpendicular distance D measured from leading edge face 104 or trailing edge end face 106. In some examples, distance D is less than or equal to eight percent of a perpendicular distance from leading edge end face 104 and trailing edge end face 106.

Bearing angle A1 and relief angle B1 can be expressed by plane angle A2 and bevel angle B2, respectively, taken relative to leading edge end face 104 or relative to trailing edge face 106. Plane angle A2 and bevel angle B2 are adjacent angles to bearing angle A1 and relief angle B1 and, accordingly, can be used to define features of attachment root 100 expressed by bearing angle A1 and relief angle B1. For instance, plane angle A2 equals ninety degrees minus bearing angle A1. Accordingly, plane angle A2 can be equal to ninety degrees (i.e., no bearing angle) or a nonzero angle less than ninety degrees and greater than zero degrees. In some instances, plane angle A2 is less than ninety degrees and greater than or equal to eighty degrees. Similarly, bevel angle B2 equals ninety degrees minus relief angle B1. In some examples, the bevel angle B2 equals ninety degrees (i.e., no bevel). In other examples, bevel angle B2 is less than ninety degrees and greater than or equal to seventy degrees. In all examples, the bevel angle B2 is always less than the plane angle A2. Whether relief angle B1 or bevel angle B2 are used, the length of the pressure side bevel 120 and suction side bevel 122 can be expressed by distance D described above.

Nonzero relief angles $\beta$1, or corresponding bevel angles $\beta$2, relieve peak contact pressure imposed on attachment root 100 at or near leading edge end face 104 and trailing edge end face 106. Contact forces between attachment root 100 and the rotor to have a pressure component that is normal to symmetry plane 108. For nonzero relief angles $\beta$1, centrifugal force reacted by attachment root 100 imposes moment M about point C of attachment root 100, which is a point on symmetry plane 108 equidistant between leading edge end face 104 and trailing edge end face 106. Pressure side bevel 120 and suction side bevel 122 remove regions of serration profile 102 and act to redistribute contact pressure along contact surfaces 116A-116F, lowering peak contact pressure at or near leading edge end face 104 and at or near trailing edge end face 106.

Figure 4:
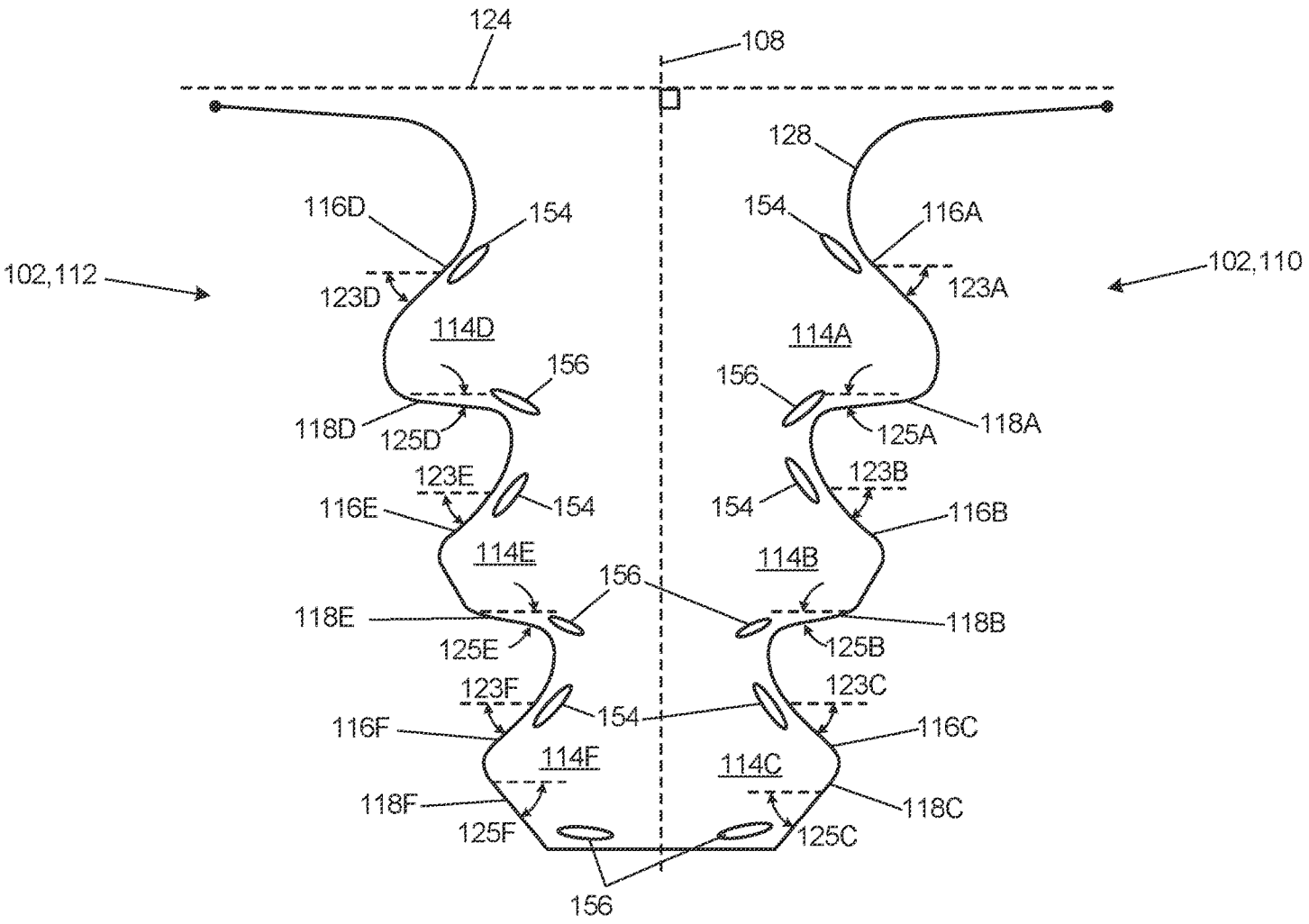
FIG. 4 is a cross sectional view depicting the serration profile of the attachment root.

FIG. 4 is a cross section that depicts serration profile 102 of attachment root 100 taken along section B-B of FIG. 3, which is perpendicular to symmetry plane 108. Pressure side profile 110 includes lobes 114A, 114B, and 114C. Lobe 114A is closest to platform 70 and airfoil 68 (i.e., the radially outermost lobe). Lobe 114C is farthest from platform 70 and airfoil 68 and accordingly may be referred to as the radially innermost lobe. Lobe 114B is positioned between lobe 114A and lobe 114C and may be referred to as an intermediate lobe. Suction side profile 112 includes lobes 114D, 114E, and 114F, which correspond to lobes 114A, 114B, and 114C, respectively. While features of serration profile 102 may be described with respect to pressure side profile 110 or suction side profile 112, it shall be understood to apply to both pressure side profile 110 and suction side profile 112.

Contact faces 116A-116F of respective lobes 114A-114F define respective contact angles 123A-123F with respect to line 124, which intersects serration profile 102 and is perpendicular to symmetry plane 108. In the example shown, contact angles 123A-123F are positive, nonzero, acute angles, each of contact angles 123A-123F equal to forty-five degrees. Non-contact surfaces 118A-118F define respective non-contact angles 125A-125F with respect to line 124. Non-contact angles 125A-125F are positive, nonzero, acute angles. In some examples, each of non-contact angles 125A-125F is greater than three degrees and less than or equal to fifty degrees.

Referring to pressure side profile 110, non-contact angles 125A, 125B, and 125C of lobes 114A, 114B, and 114C increase with each successive lobe in the radially inward direction (i.e., in a direction moving away from platform 70). In the depicted example, non-contact angle 125A of lobe 114A is less than non-contact angle 125B of lobe 118B. Similarly, non-contact angle 125B of lobe 114B is less than non-contact angle 125C of lobe 114C. In some examples, non-contact angle 125A of lobe 114A is greater than three degrees and less than twelve degrees. In the same example, non-contact angle 125B of lobe 114B is less than or equal to seventeen degrees and greater than or equal to twelve degrees, and non-contact angle 125C of lobe 114C is less than or equal to fifty degrees and greater than or equal to forty-five degrees. In yet other examples, non-contact angles 125A, 125B, and 125C are equal to seven degrees, twelve degrees, and fifty degrees for lobes 114A, 114B, and 114C, respectively.

Suction-side profile 111 includes lobes 114D, 114E, and 114F that mirror lobes 114A, 114B, and 114C of pressure side profile 110. Accordingly, where non-contact angles 125A-125C increase in a radially inward direction (i.e., in a direction away from platform 70), non-contact angles 125D, 125E, and 125F correspond to described ranges for non-contact angles 125A, 125B, and 125C of pressure-side profile 112, respectively.

Airfoils of gas turbine engine 10 experience centrifugal forces from rotation about centerline axis 12 during operation of gas turbine engine. Contact forces between attachment root 100 and the rotor impose a bending moment on each lobe 114 (e.g., lobes 114A-114F) of serration profile 102. As shown in FIG. 4, tensile stress zones 154 are created at the inboard or proximal ends of lobes 114A-114F on the contact surfaces 116A-116F, and compressive stress zones 156 are created at the inboard or proximal end of lobes 114A-114F on the non-contact surfaces 118A-118F. By increasing the non-contact angles 125A, 125B, and 125C of respective lobes 114A, 114B, and 114C greater than three degrees, peak compressive stresses in zones 156 are reduced. Especially when combined with pressure side bevel 120 and suction side bevel 122, serration profiles 102 in which non-contact angles 125A, 125B, and 125C are greater than three degrees or have progressively increasing non-contact angles 125A, 125B, and 125C in the radially inward direction can withstand higher compressive stresses from centrifugal loading. Compressive stress capacity is particularly relevant in high temperature operation, such as experienced by blades of high-pressure turbine 34.

Discussion of Possible Embodiments

The following are non-exclusive descriptions of possible embodiments of the present invention.

Attachment Root

An attachment root according to an example embodiment of this disclosure includes, among other possible things, a serration profile and a first lobe define relative to a plane and a line. The plane bisects the serration profile, and the serration profile is symmetric about the plane. The line intersects the serration profile that is normal to the plane. The first lobe is spaced from the plane. The first lobe includes a first contact surface and a first non-contact surface. The first contact surface defining a first acute angle between the first contact surface and the line. The first acute angle equal forty-five degrees. The first non-contact surface defines a second acute angle between the first non-contact surface and the line. The second acute angle is greater than three degrees.

The attachment root of the preceding paragraph can optionally include, additionally and/or alternatively, any one or more of the following features, configurations and/or additional components.

A further embodiment of the foregoing attachment root can further include a second lobe of the serration profile.

A further embodiment of any of the foregoing attachment roots, wherein the second lobe can include a second contact surface defining a third acute angle between the second contact surface the line.

A further embodiment of any of the foregoing attachment roots, wherein the third acute angle can equal forty-five degrees.

A further embodiment of any of the foregoing attachment roots, wherein the second lobe can include a second non-contact surface defining a fourth acute angle between the second non-contact surface and the line.

A further embodiment of any of the foregoing attachment roots, wherein the fourth acute angle can be greater than the first acute angle.

A further embodiment of any of the foregoing attachment roots can further include a third lobe of the serration profile.

A further embodiment of any of the foregoing attachment roots, wherein the third lobe can include a third contact surface defining a fifth acute angle between the third contact surface and the line.

A further embodiment of any of the foregoing attachment roots, wherein the fifth acute angle can equal forty-five degrees.

A further embodiment of any of the foregoing attachment roots, wherein the third lobe can include a third non-contact surface defining a sixth acute angle between the third non-contact surface and the line.

A further embodiment of any of the foregoing attachment roots, wherein the sixth acute angle can be greater than forth-five degrees.

A further embodiment of any of the foregoing attachment roots, wherein the second acute angle can be at least seven degrees.

A further embodiment of any of the foregoing attachment roots, wherein the second acute angle can be less than twelve degrees.

A further embodiment of any of the foregoing attachment roots, wherein the fourth acute angle can be at least twelve degrees.

A further embodiment of any of the foregoing attachment roots, wherein the fourth acute angle can be less than seventeen degrees.

A further embodiment of any of the foregoing attachment roots can further include a first end face and a second end face. The serration profile extends from the first end face to the second end face.

A further embodiment of any of the foregoing attachment roots, wherein the plane can define a plane angle with the first end face that is greater than or equal to eighty degrees and less than ninety degrees.

A further embodiment of any of the foregoing attachment roots can further include a first bevel and a second bevel. The first bevel is located at the intersection of the serration profile and the first end face. The second bevel is located at the intersection of the serration profile and the second end face parallel that is parallel to the first bevel.

A further embodiment of any of the foregoing attachment roots, wherein the first bevel can define a bevel angle with the first end face greater than or equal to seventy degrees and less than or equal to seventy-five degrees.

A further embodiment of any of the foregoing attachment roots, wherein the plane extends between the first bevel and the second bevel.

Rotor Blade

A rotor blade according to an example embodiment of this disclosure includes, among other possible things, a platform, an airfoil, and an attachment root. The airfoil extends from the platform in a spanwise direction to a tip and in a chordwise direction from a leading edge to a trailing edge. The attachment root extends from the platform opposite the airfoil. The attachment root includes a serration profile and a first lobe defined relative to a plane and a line. The plane bisects the serration profile, and the serration profile is symmetric about the plane. The line intersects the serration profile that is normal to the plane. The first lobe is spaced from the plane. The first lobe includes a first contact surface and a first non-contact surface. The first contact surface defining a first acute angle between the first contact surface and the line. The first acute angle equal forty-five degrees. The first non-contact surface defines a second acute angle between the first non-contact surface and the line. The second acute angle is greater than three degrees.

The rotor blade of the preceding paragraph can optionally include, additionally and/or alternatively, any one or more of the following features, configurations and/or additional components.

A further embodiment of the foregoing rotor blade, wherein the attachment root can include a second lobe of the serration profile.

A further embodiment of any of the foregoing rotor blades, wherein the second lobe can include a second contact surface defining a third acute angle between the second contact surface the line.

A further embodiment of any of the foregoing rotor blades, wherein the third acute angle can equal forty-five degrees.

A further embodiment of any of the foregoing rotor blades, wherein the second lobe can include a second non-contact surface defining a fourth acute angle between the second non-contact surface and the line.

A further embodiment of any of the foregoing rotor blades, wherein the fourth acute angle can be greater than the first acute angle.

A further embodiment of any of the foregoing rotor blades, wherein the attachment root can include a third lobe of the serration profile.

A further embodiment of any of the foregoing rotor blades, wherein the third lobe can include a third contact surface defining a fifth acute angle between the third contact surface and the line.

A further embodiment of any of the foregoing rotor blades, wherein the fifth acute angle can equal forty-five degrees.

A further embodiment of any of the foregoing rotor blades, wherein the third lobe can include a third non-contact surface defining a sixth acute angle between the third non-contact surface and the line.

A further embodiment of any of the foregoing rotor blades, wherein the sixth acute angle can be greater than forth-five degrees.

A further embodiment of any of the foregoing rotor blades, wherein the second acute angle can be at least seven degrees.

A further embodiment of any of the foregoing rotor blades, wherein the second acute angle can be less than twelve degrees.

A further embodiment of any of the foregoing rotor blades, wherein the fourth acute angle can be at least twelve degrees.

A further embodiment of any of the foregoing rotor blades, wherein the fourth acute angle can be less than seventeen degrees.

A further embodiment of any of the foregoing rotor blades, wherein the attachment root can include a first end face and a second end face. The serration profile extends from the first end face to the second end face.

A further embodiment of any of the foregoing rotor blades, wherein the plane can define a plane angle with the first end face that is greater than or equal to eighty degrees and less than ninety degrees.

A further embodiment of any of the foregoing rotor blades, wherein the attachment root can include a first bevel and a second bevel. The first bevel is located at the intersection of the serration profile and the first end face. The second bevel is located at the intersection of the serration profile and the second end face parallel that is parallel to the first bevel.

A further embodiment of any of the foregoing rotor blades, wherein the first bevel can define a bevel angle with the first end face greater than or equal to seventy degrees and less than or equal to seventy-five degrees.

A further embodiment of any of the foregoing rotor blades, wherein the plane extends between the first bevel and the second bevel.

High-Pressure Turbine

A high-pressure turbine according to an example embodiment of this disclosure includes, among other possible things, a rotor, an airfoil, and an attachment root. The attachment root couples the airfoil to the rotor. The attachment root includes a serration profile and a first lobe defined relative to a plane and a line. The plane bisects the serration profile, and the serration profile is symmetric about the plane. The line intersects the serration profile that is normal to the plane. The first lobe is spaced from the plane. The first lobe includes a first contact surface and a first non-contact surface. The first contact surface defining a first acute angle between the first contact surface and the line. The first acute angle equal forty-five degrees. The first non-contact surface defines a second acute angle between the first non-contact surface and the line. The second acute angle is greater than three degrees.

The high-pressure turbine of the preceding paragraph can optionally include, additionally and/or alternatively, any one or more of the following features, configurations and/or additional components.

A further embodiment of the foregoing high-pressure turbine, wherein the attachment root can include a second lobe of the serration profile.

A further embodiment of any of the foregoing high-pressure turbines, wherein the second lobe can include a second contact surface defining a third acute angle between the second contact surface the line.

A further embodiment of any of the foregoing high-pressure turbines, wherein the third acute angle can equal forty-five degrees.

A further embodiment of any of the foregoing high-pressure turbines, wherein the second lobe can include a second non-contact surface defining a fourth acute angle between the second non-contact surface and the line.

A further embodiment of any of the foregoing high-pressure turbines, wherein the fourth acute angle can be greater than the first acute angle.

A further embodiment of any of the foregoing high-pressure turbines, wherein the attachment root can include a third lobe of the serration profile.

A further embodiment of any of the foregoing high-pressure turbines, wherein the third lobe can include a third contact surface defining a fifth acute angle between the third contact surface and the line.

A further embodiment of any of the foregoing high-pressure turbines, wherein the fifth acute angle can equal forty-five degrees.

A further embodiment of any of the foregoing high-pressure turbines, wherein the third lobe can include a third non-contact surface defining a sixth acute angle between the third non-contact surface and the line.

A further embodiment of any of the foregoing high-pressure turbines, wherein the sixth acute angle can be greater than forth-five degrees.

A further embodiment of any of the foregoing high-pressure turbines, wherein the second acute angle can be at least seven degrees.

A further embodiment of any of the foregoing high-pressure turbines, wherein the second acute angle can be less than twelve degrees.

A further embodiment of any of the foregoing high-pressure turbines, wherein the fourth acute angle can be at least twelve degrees.

A further embodiment of any of the foregoing high-pressure turbines, wherein the fourth acute angle can be less than seventeen degrees.

A further embodiment of any of the foregoing high-pressure turbines, wherein the attachment root can include a first end face and a second end face. The serration profile extends from the first end face to the second end face.

A further embodiment of any of the foregoing high-pressure turbines, wherein the plane can define a plane angle with the first end face that is greater than or equal to eighty degrees and less than ninety degrees.

A further embodiment of any of the foregoing high-pressure turbines, wherein the attachment root can include a first bevel and a second bevel. The first bevel is located at the intersection of the serration profile and the first end face. The second bevel is located at the intersection of the serration profile and the second end face parallel that is parallel to the first bevel.

A further embodiment of any of the foregoing high-pressure turbines, wherein the first bevel can define a bevel angle with the first end face greater than or equal to seventy degrees and less than or equal to seventy-five degrees.

A further embodiment of any of the foregoing high-pressure turbines, wherein the plane extends between the first bevel and the second bevel.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An attachment root of an airfoil comprising:
- a serration profile that is symmetric about a plane bisecting the serration profile; and
- a first lobe of the serration profile spaced from the plane and described relative to a line intersecting the serration profile that is normal to the plane, the first lobe comprising:
  - a first contact surface defining a first acute angle between the first contact surface and the line, wherein the first acute angle equals forty-five degrees; and
  - a first non-contact surface defining a second acute angle between the first non-contact surface and the line, wherein the second acute angle is greater than three degrees; and
- a second lobe of the serration profile spaced from the symmetry plane, the second lobe comprising:
  - a second contact surface defining a third acute angle between the second contact surface and the line, wherein the third acute angle equals forty-five degrees; and
  - a second non-contact surface defining a fourth acute angle between the second non-contact surface and the line, wherein the fourth acute angle is greater than the second acute angle.

2. The attachment root of claim 1, further comprising:
- a third lobe of the serration profile spaced from the plane, the third lobe comprising:
  - a third contact surface defining a fifth acute angle between the third contact surface and the line, wherein the fifth acute angle equals forty-five degrees; and
  - a second non-contact surface defining a sixth acute angle between the third non-contact surface and the line, wherein the sixth acute angle is greater than forty-five degrees.

3. The attachment root of claim 2, wherein the second acute angle is at least seven degrees and the fourth acute angle is at least twelve degrees.

4. The attachment root of claim 3, wherein the second acute angle is less than twelve degrees and the fourth acute angle is less than seventeen degrees.

5. The attachment root of claim 1, further comprising:
- a first end face; and
- a second end face parallel to the first end face, wherein the serration profile extends from the first end face to the second end face, and wherein the plane defines a plane angle with the first end face greater than or equal to eighty degrees and less than ninety degrees.

6. The attachment root of claim 5, further comprising:
- a first bevel at the intersection of the serration profile and the first end face; and
- a second bevel at the intersection of the serration profile and the second end face that is parallel to the first bevel, wherein the first bevel defines a bevel angle with the first end face greater than or equal to seventy degrees and less than or equal to seventy-five degrees.

7. A rotor blade comprising:
- a platform;
- an airfoil extending from the platform in a spanwise direction to a tip and in a chordwise direction from a leading edge to a trailing edge; and
- an attachment root extending from the platform opposite the airfoil, the attachment root comprising:
  - a serration profile that is symmetric about a plane bisecting the serration profile; and
  - a first lobe of the serration profile spaced from the plane and described relative to a line intersecting the serration profile that is normal to the plane, the first lobe comprising:
    - a first contact surface defining a first acute angle between the first contact surface and the line, wherein the first acute angle equals forty-five degrees; and
    - a first non-contact surface defining a second acute angle between the first non-contact surface and the line, wherein the second acute angle is greater than three degrees; and
- a second lobe of the serration profile spaced from the plane, the second lobe comprising:
  - a second contact surface defining a third acute angle between the second contact surface and the line, wherein the third acute angle equals forty-five degrees; and
  - a second non-contact surface defining a fourth acute angle between the second non-contact surface and the line, wherein the fourth acute angle is greater than the second acute angle.

8. The rotor blade of claim 7, further comprising:
- a third lobe of the serration profile spaced from the plane, the third lobe comprising:

a third contact surface defining a fifth acute angle between the third contact surface and the line, wherein the fifth acute angle equals forty-five degrees; and a third non-contact surface defining a sixth acute angle between the third non-contact surface and the line, wherein the sixth acute angle is greater than forty-five degrees.

9. The rotor blade of claim 8, wherein the second acute angle is at least seven degrees and the fourth acute angle is at least twelve degrees.

10. The rotor blade of claim 9, wherein the second acute angle is less than twelve degrees and the fourth acute angle is less than seventeen degrees.

11. The rotor blade of claim 7, further comprising:

a first end face; and a second end face parallel to the first end face, wherein the serration profile extends from the first end face to the second end face, and wherein the plane defines a plane angle with the first end face greater than or equal to eighty degrees and less than ninety degrees.

12. The rotor blade of claim 11, further comprising:

a first bevel at the intersection of the serration profile and the first end face; and a second bevel at the intersection of the serration profile and the second end face parallel to the first bevel, wherein the first bevel defines a bevel angle with the first end face greater than or equal to seventy degrees and less than or equal to seventy-five degrees.

13. A high-pressure turbine comprising:

a rotor;

an airfoil;

an attachment root coupling the airfoil to the rotor, the attachment root comprising:

a serration profile that is symmetric about a plane bisecting the serration profile; and a first lobe of the serration profile spaced from the plane and described relative to a line intersecting the serration profile that is normal to the plane, the first lobe comprising:

a first contact surface defining a first acute angle between the first contact surface and the line, wherein the first acute angle equals forty-five degrees; and a first non-contact surface defining a second acute angle between the first non-contact surface and the line, wherein the second acute angle is greater than three degrees; and a second lobe of the serration profile spaced from the plane, the second lobe comprising:

a second contact surface defining a third acute angle between the second contact surface and the line, wherein the third acute angle equals forty-five degrees; and a second non-contact surface defining a fourth acute angle between the second non-contact surface and the line, wherein the fourth acute angle is greater than the second acute angle.

14. The high-pressure turbine of claim 13, further comprising:

a third lobe of the serration profile spaced from the plane, the third lobe comprising:

a third contact surface defining a fifth acute angle between the third contact surface and the line, wherein the fifth acute angle equals forty-five degrees; and a third non-contact surface defining a sixth acute angle between the third non-contact surface and the line, wherein the sixth acute angle is greater than forty-five degrees.

15. The high-pressure turbine of claim 14, wherein the second acute angle is at least seven degrees and the fourth acute angle is at least twelve degrees, and wherein the second acute angle is less than twelve degrees and the fourth acute angle is less than seventeen degrees.

16. The high-pressure turbine of claim 13, further comprising:

a first end face; and a second end face parallel to the first end face, wherein the serration profile extends from the first end face to the second end face, and wherein the plane defines a plane angle with the first end face greater than or equal to eighty degrees and less than ninety degrees.

17. The high-pressure turbine of claim 16, further comprising:

a first bevel at the intersection of the serration profile and the first end face; and a second bevel at the intersection of the serration profile and the second end face parallel to the first bevel, wherein the first bevel defines a bevel angle with the first end face greater than or equal to seventy degrees and less than or equal to seventy-five degrees.

* * * * *